US009566486B2

(12) United States Patent
Griffith et al.

(10) Patent No.: US 9,566,486 B2
(45) Date of Patent: Feb. 14, 2017

(54) GOLF SHAFT AND METHOD OF MANUFACTURING SAME

(71) Applicant: True Temper Sports, Inc., Memphis, TN (US)

(72) Inventors: Thomas Daniel Griffith, Amory, MS (US); Michael Parker Gardner, Amory, MS (US); James Boyce Barton, Saltillo, MS (US); Gregory William Cavill, Germantown, TN (US)

(73) Assignee: TRUE TEMPER SPORTS, INC., Memphis, TN (US)

( * ) Notice: Subject to any disclaimer, the term of this patent is extended or adjusted under 35 U.S.C. 154(b) by 0 days.

(21) Appl. No.: 14/682,584

(22) Filed: Apr. 9, 2015

(65) Prior Publication Data

US 2015/0290505 A1 Oct. 15, 2015

Related U.S. Application Data

(60) Provisional application No. 61/978,411, filed on Apr. 11, 2014.

(51) Int. Cl.
*A63B 53/12* (2015.01)

(52) U.S. Cl.
CPC ..... *A63B 53/12* (2013.01)

(58) Field of Classification Search
CPC ..... A63B 53/12
See application file for complete search history.

(56) References Cited

U.S. PATENT DOCUMENTS

| | | | | | |
|---|---|---|---|---|---|
| 2,220,852 | A | * | 11/1940 | Scott | A63B 53/12 473/323 |
| D245,441 | S | * | 8/1977 | Middlestadt | 473/314 |
| 4,205,845 | A | | 6/1980 | Kanne | |
| 4,555,112 | A | | 11/1985 | Masghati | |
| 4,563,007 | A | | 1/1986 | Bayliss et al. | |
| D351,643 | S | * | 10/1994 | Gubany | D21/738 |
| 5,496,028 | A | * | 3/1996 | Chien | A63B 53/10 273/DIG. 23 |

(Continued)

FOREIGN PATENT DOCUMENTS

| | | | | |
|---|---|---|---|---|
| EP | 0 724 895 A1 | | 8/1996 | |
| GB | 256049 A | * | 8/1926 | A63B 53/12 |

(Continued)

OTHER PUBLICATIONS

Black & White drawing; True Temper Sports; 2011; 1 page.

*Primary Examiner* — Stephen Blau
(74) *Attorney, Agent, or Firm* — Harness, Dickey & Pierce, P.L.C.

(57) ABSTRACT

A tubular steel golf shaft comprising a grip section, a tapered mid-section and a tip section. A loading zone is selectively formed along a portion of the shaft, preferably in the tapered mid-section, comprising a continuous series of closely spaced micro-steps, or reductions in diameter, each of which are less than 0.5 inches in length. Each micro-step section, in the direction from the grip section toward the tip section comprises a first peak which descends to valley and then ascends to a second peak. The diameter of the first peak is greater than the diameter of the second peak. A method of manufacturing the golf shaft is also disclosed.

23 Claims, 10 Drawing Sheets

(56) References Cited

U.S. PATENT DOCUMENTS 5,599,242 A * 2/1997 Solviche ..... A63B 53/10 273/DIG. 23
5,735,752 A * 4/1998 Antonious ..... A63B 53/10 473/317
5,776,008 A * 7/1998 Lundberg ..... A63B 53/10 273/DIG. 23
D401,981 S * 12/1998 Yoo ..... D21/747
5,865,688 A * 2/1999 Bae ..... A63B 53/10 473/323
5,904,628 A * 5/1999 MacKay, Jr. ..... A63B 53/00 473/300
5,944,618 A * 8/1999 Cheng ..... A63B 53/10 273/DIG. 23
D421,783 S * 3/2000 Ryu ..... D21/757
6,117,021 A * 9/2000 Crow ..... A63B 53/10 473/289
6,231,457 B1 * 5/2001 Chen ..... A63B 53/10 473/305
6,302,805 B1 * 10/2001 Penley ..... A63B 53/10 473/318
6,354,960 B1 * 3/2002 Perryman ..... A63B 53/10 473/318
6,520,867 B1 * 2/2003 Miura ..... A63B 53/10 473/316
8,758,158 B2 * 6/2014 Jennings ..... A63B 53/10 473/282
2002/0077194 A1 * 6/2002 Carr ..... A63B 53/12 473/317
2002/0155899 A1 * 10/2002 Ryu ..... A63B 53/10 473/316
2005/0148404 A1 * 7/2005 Ignatius ..... A63B 49/00 473/318
2006/0128495 A1 6/2006 Braly et al.

FOREIGN PATENT DOCUMENTS

JP 2000126344 A * 5/2000
JP 2002291951 A * 10/2002
WO WO 81/00521 3/1981
WO WO 0139847 A1 * 6/2001 ..... A63B 53/12

* cited by examiner

GOLF SHAFT AND METHOD OF MANUFACTURING SAME

CROSS-REFERENCE TO RELATED APPLICATION

This application claims the benefit of U.S. Provisional Application No. 61/978,411, filed Apr. 11, 2014. The disclosure of the above application is herein incorporated by reference.

FIELD OF THE INVENTION

The present invention relates to golf shafts, and in particular, to steel golf shafts having a load zone selectively positioned along the length of the shaft that is comprised of a plurality of closely spaced micro-steps, or drops in diameter, that give the shaft a ripple appearance in the load zone.

BACKGROUND OF THE INVENTION

A conventional steel golf shaft can be described as a tapered tube comprising three main sections: a grip section, a mid-section and a tip section.

The grip section comprises a parallel (in cross-section) tube with typical sizes ranging from 0.560 to 0.625 of an inch in diameter. During the club assembly process the grip section is cut to length prior to being covered in a rubber or leather grip that the player will hold.

The mid-section is the tapered part of the shaft. This section can comprise either a series of discrete steps or reductions in diameter, a constant or "smooth" plain taper, or a combination of both. The rate at which the diameter is reduced in this section is directly related to the overall stiffness of the shaft.

The tip section is generally parallel, and approximately 0.370 of an inch in diameter, and can vary in length depending on the stiffness requirements and the length of the club. In general, the tip section of a shaft is the longest for a driver and the shortest for a wedge. The diameter of the tip section is directly related to the shaft stiffness and playability. The larger the diameter the stiffer the shaft will play; conversely the smaller the diameter the softer or more flexible the shaft will play. When designing golf shafts the relationship between the length and diameters of both the tip and grip sections determines the overall playing characteristics of the shaft.

In addition to the outer geometry, the wall thickness of the shaft is also tightly controlled and has a significant influence on the overall performance of the shaft. Wall thickness is directly related to the overall weight of the shaft and can be manipulated to change both the bending stiffness and balance point of the shaft.

An exemplary conventional "stepped" steel golf shaft is illustrated in FIG. 1. Starting from the upper end of the mid-section adjacent the grip end, the exemplary steel golf shaft may have a first series of four reductions of 0.020 of an inch each, spaced approximately 1.75 inches apart, and a second series of ten reductions of 0.015 of an inch each, spaced approximately 1.5 inches apart.

The diameter reductions are achieved through the use of a plurality of step dies each further reducing the diameter along the shaft from the butt end to the tip end. Due to limitations of both the process and material, step tapers are generally limited to diameter reductions equal to or greater than 0.010 of an inch and cannot be spaced consistently and reliably at less than about 0.50 of an inch apart.

The taper steps are generally located along the mid-section of the shaft in a manner and location that achieves specific flexural characteristics of the shaft.

In an optional secondary swage process, these steps can be blended into the overall taper of the shaft so that the individual taper steps are no longer visible.

As explained in U.S. Pat. No. 5,989,133, the conventional taper press operation consists of a process whereby a steel tube is pushed through a series of support bushings and then into a forming die of a smaller diameter. When removed from the die, the formed part of the tube maintains the smaller diameter. This operation is repeated on a rotary taper press machine that can place a series of steps on one shaft. The taper press operation is a very consistent and reliable method of forming diameter drops of between 0.010" and 0.025". However, it has limited use when forming smaller reductions in diameter as the reduced forming loads can allow the tube to be pulled to one side resulting in a non-concentric half step. Due to the limited number of forming barrels there is also a limit to the number of steps that can be formed, which negates the possibility of forming a series of very small steps in an efficient manner.

As noted above, it is also known within the golf industry to use a swaging process to form so-called plain taper or "stepless" steel golf shafts. The swaging process works by forcing a pre-formed or blank tube into a set of half dies that are rotated while opening and closing at very high speed. The dies themselves have the final form cut into their working surfaces, so that when the dies are closed they form a cavity to which the tube conforms. Shafts formed via the swaging process provide a generally constant taper rate that result in a shaft having a smooth or "featureless" appearance.

It is an object of the present invention to provide a steel golf shaft having a loading zone that is selectively positioned along the length of the shaft and formed by a plurality of closely spaced "micro-steps," or drops in diameter, that modify the bending and playing characteristics of the shaft in a variety of predictable ways. In addition, it is a further object of the present invention to provide a unique process for producing such a golf shaft.

BRIEF DESCRIPTION OF THE DRAWINGS

FIG. 3(*a*) is an enlarged view of the load zone of the golf shaft shown in FIG. 2;

FIG. 3(*b*) is an enlarged view of one of the micro-step sections of the load zone shown in FIG. 3(*a*);

FIG. 3(*c*) is an additional enlarged view of one of the micro-step sections of the load zone shown in FIG. 3(*a*);

FIG. 9(*b*) illustrates an exemplary preformed shaft produced by the preliminary taper press process used in the preferred manufacturing process according to the present invention;

FIG. 9(*c*) illustrates an exemplary final shaft form produced by the manufacturing process according to the present invention;

DETAILED DESCRIPTION OF THE PREFERRED EMBODIMENTS

Figure 2:
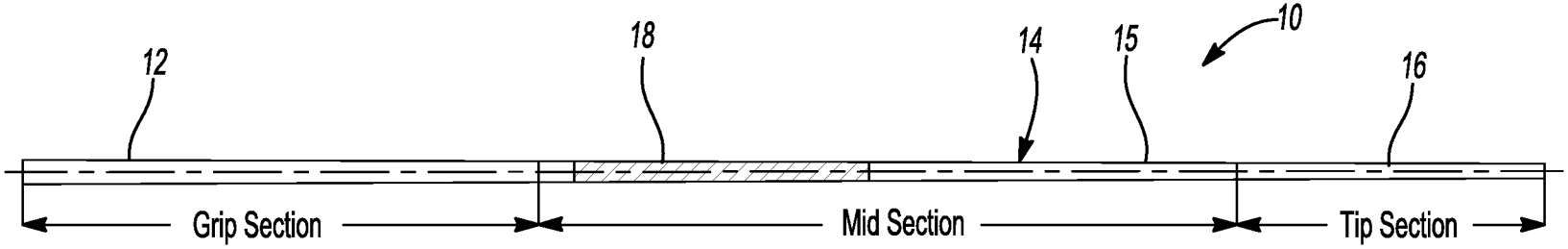
FIG. 2 is a plan view of a golf shaft according to the present invention.

Referring to FIGS. 2 and 3(*a*)-3(*c*), an exemplary golf shaft 10 incorporating the features of the present invention is shown. Consistent with the general design of a conventional steel golf shaft, the golf shaft 10 according to the present invention also comprises a constant diameter grip section 12 at one end, a constant smaller diameter tip section 16 at the other end, and a tapered mid-section 14 intermediate the grip and tip sections. In a first preferred embodiment, the mid-section 14 of the golf shaft 10 is formed with a smooth or "stepless," constant taper portion 15 in the lower portion adjacent to the tip section 16 and a loading zone 18 in the upper portion of the mid-section 14 of the shaft adjacent to the grip section 12. The loading zone 18 comprises a plurality of successive micro-steps, or diameter reductions. The depth of each step "B" and the length of each section "A" are dependent on the desired change in localized shaft stiffness. (FIG. 3). In particular, by increasing the value of "B" the localized bending stiffness of the shaft is reduced.

Preferably, the loading zone 18 is formed continuously along at least a 6 inch lineal region of the golf shaft and comprises at least 24 successive micro-step sections "A". The exemplary loading zone 18 of the golf shaft shown in FIGS. 2 and 3 consists of 32 equally spaced micro-step sections "A" formed along an 8-inch lineal region of the shaft. Each section "A" consists of a first peak 20, followed by a valley 22, and ending at a second peak 24. Preferably, the valley 22 in each micro-step section "A" is located substantially midway between the first peak 20 and the second peak 22. Starting from the grip end 12 and progressing toward the tip end 16, the first peak 20 of each section "A" is greater than the second peak 24 which is greater than the valley 22. The second peak 24 comprises the first peak in the next micro-step section "A" in the progression. The value of "B" corresponds to the dimensional difference between the first peak 20 and the valley 22. Preferably, the value of "B" expressed as a diameter is less than or equal to 0.010 inches, preferably within the range of 0.003-0.010 inches, and further preferably 0.005 inches.

Figures 3A, 3B, 3C, 4:
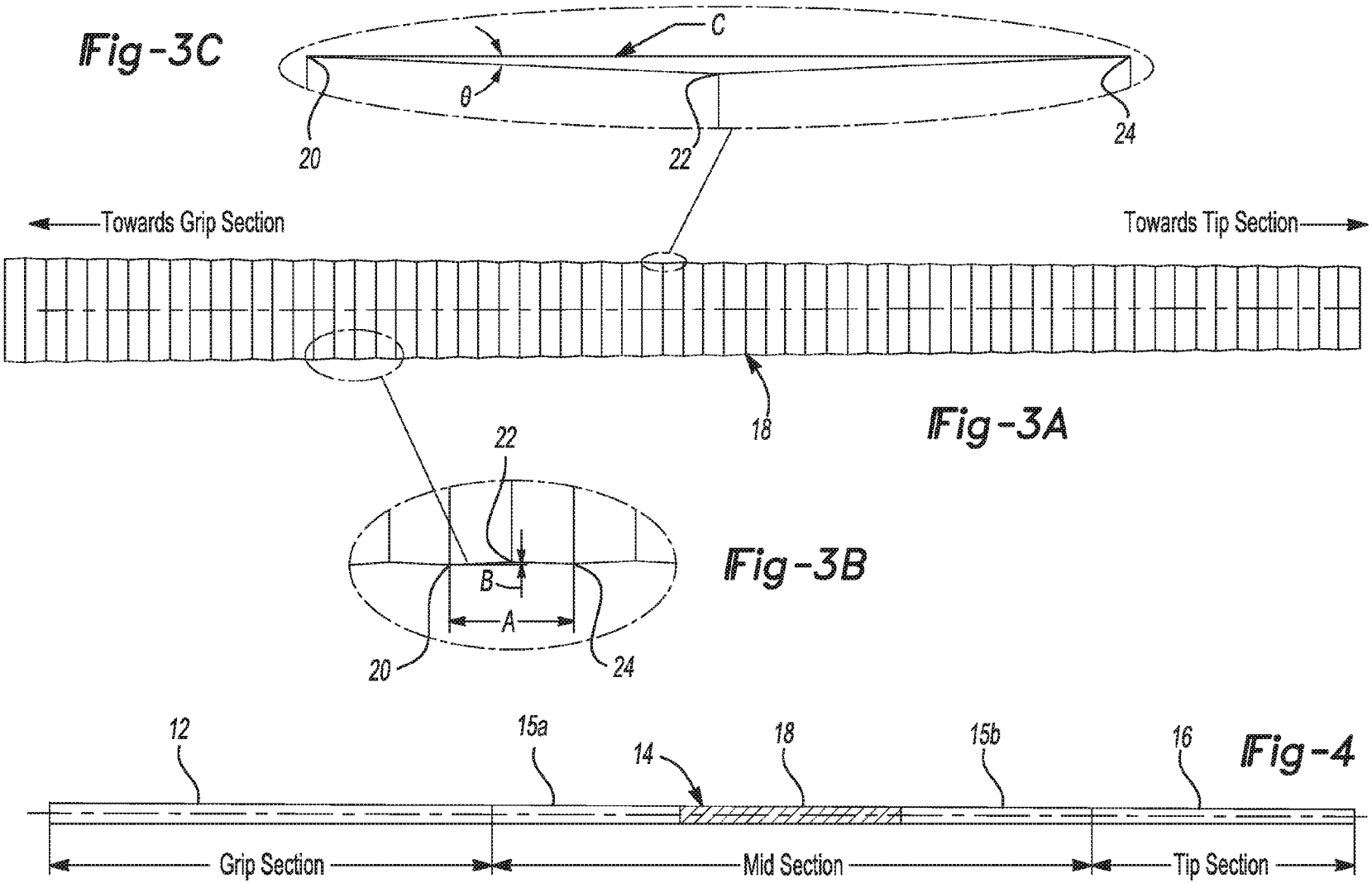
FIG. 4 is a plan view of an alternative embodiment of a golf shaft according to the present invention.

In the preferred embodiment, the dimensional reduction in diameter from the first peak 20 to the second peak 24, designated "C" in FIG. 3(*c*), is selected to produce a taper rate in inches of between 0.005 and 0.025 per lineal inch, and is preferably 0.0128 per lineal inch. Preferably, this taper rate is maintained constant throughout the loading zone 18, and may also be consistent with the taper rate in the lower mid-section portion 15 of the shaft. In addition, the lineal distance of each micro-step section "A" is less than 0.5 inches and preferably between 0.125 and 0.25 inches. Consequently, the "ripple" effect created by the successive micro-step sections "A" in the loading zone 18 is very subtle. In particular, the resulting angle, designated "θ" in FIG. 3C, formed by each micro-step section relative to the overall taper line of the loading zone 18, is very shallow and ranges from approximately 1 degree to approximately 5 degrees.

Optionally, the taper rate of the lower mid-section portion 15 may differ from the overall taper rate of the loading zone 18. In particular, the taper rate of the lower mid-section portion 15 may be reduced to 0.0106 per lineal inch.

Loading zones with other profiles are also possible. For example, the micro-step sections "A" may increase in length and/or depth from the grip end section toward the tip end section. By controlling all three of the noted parameters "A", "B" and "C", which define the loading zone 18, the localized stiffness profile of the shaft can be modified as desired. In this manner, the playing characteristics or "feel" of the golf shaft can similarly be adjusted as desired.

In addition, it is further possible to vary the angle of the two sides of the valley 22 independently of one another, which principally alters the visual effect produced by the loading zone 18 of the shaft according to the present invention.

Turning now to FIG. 4, an alternative embodiment of a golf shaft according to the present invention is shown. In this embodiment, the loading zone 18 is formed in the middle of the mid-section 14, midway between the grip section 12 and the tip section 16. In other words, the mid-section 14 comprises a first stepless, constant taper portion 15*a* adjacent the grip section 12, an intermediate loading zone 18, and a second stepless constant taper portion 15*b* adjacent the tip section 16. Preferably, the taper rate along the entire length of the mid-section 14 of the shaft is maintained at a constant value within the range discussed above.

Figure 5:
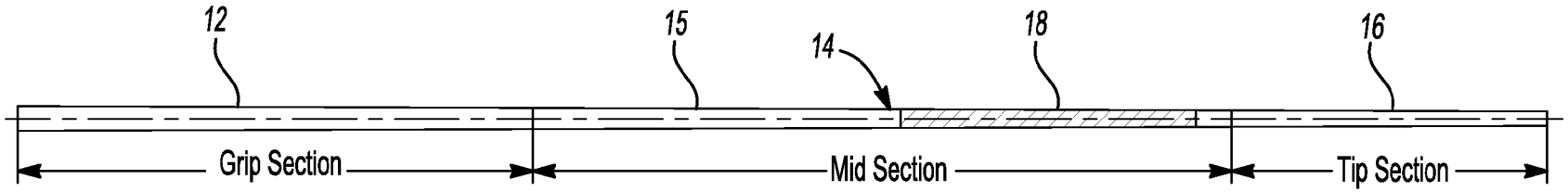
FIG. 5 is a plan view of another alternative embodiment of a golf shaft according to the present invention.

In a further alternative embodiment illustrated in FIG. 5, the loading zone 18 is formed at the lower end of the mid-section 14 adjacent to the tip section 16. In other words, the mid-section 14 of the shaft in this embodiment comprises a stepless, constant taper portion 15 adjacent the grip section 12 and a loading zone 18 adjacent the tip section 16. Preferably, the stepless, constant taper portion 15 comprises slightly more than half of the mid-section by length, and has a taper rate consistent with the overall taper rate of the loading zone 18, and within the range discussed above.

Figure 6:
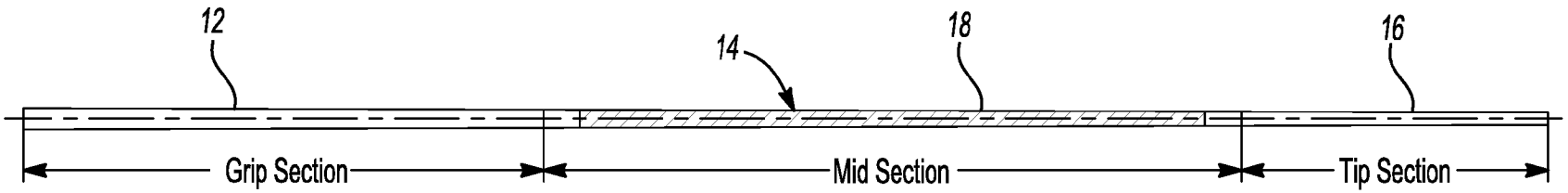
FIG. 6 is a plan view of another alternative embodiment of a golf shaft according to the present invention.

In a further alternative embodiment illustrated in FIG. 6, the loading zone 18 is formed over substantially the entire length of the mid-section 14 region of the golf shaft 10, and is formed with an overall taper rate within the range discussed above.

Figure 7:
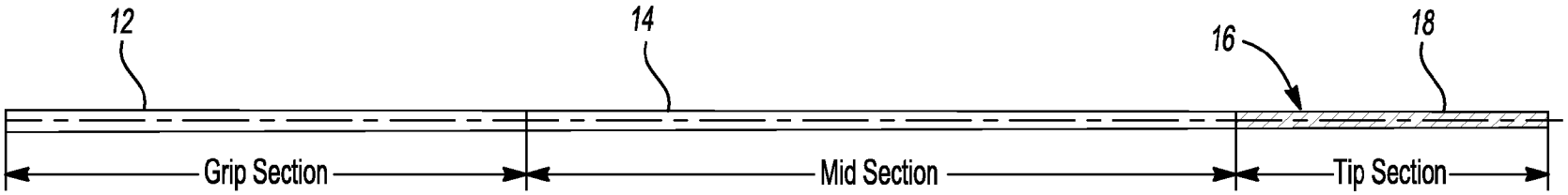
FIG. 7 is a plan view of another alternative embodiment of a golf shaft according to the present invention.

In a still further alternative embodiment illustrated in FIG. 7, the loading zone 18 is formed over substantially the entire length of the tip section 16. In this embodiment, the tip section 16 may retain an overall constant diameter. Alternatively, the loading zone 18 may be formed so as to impart an overall taper rate in the tip section 16, depending on the desired playing characteristics of the shaft.

Figure 8:
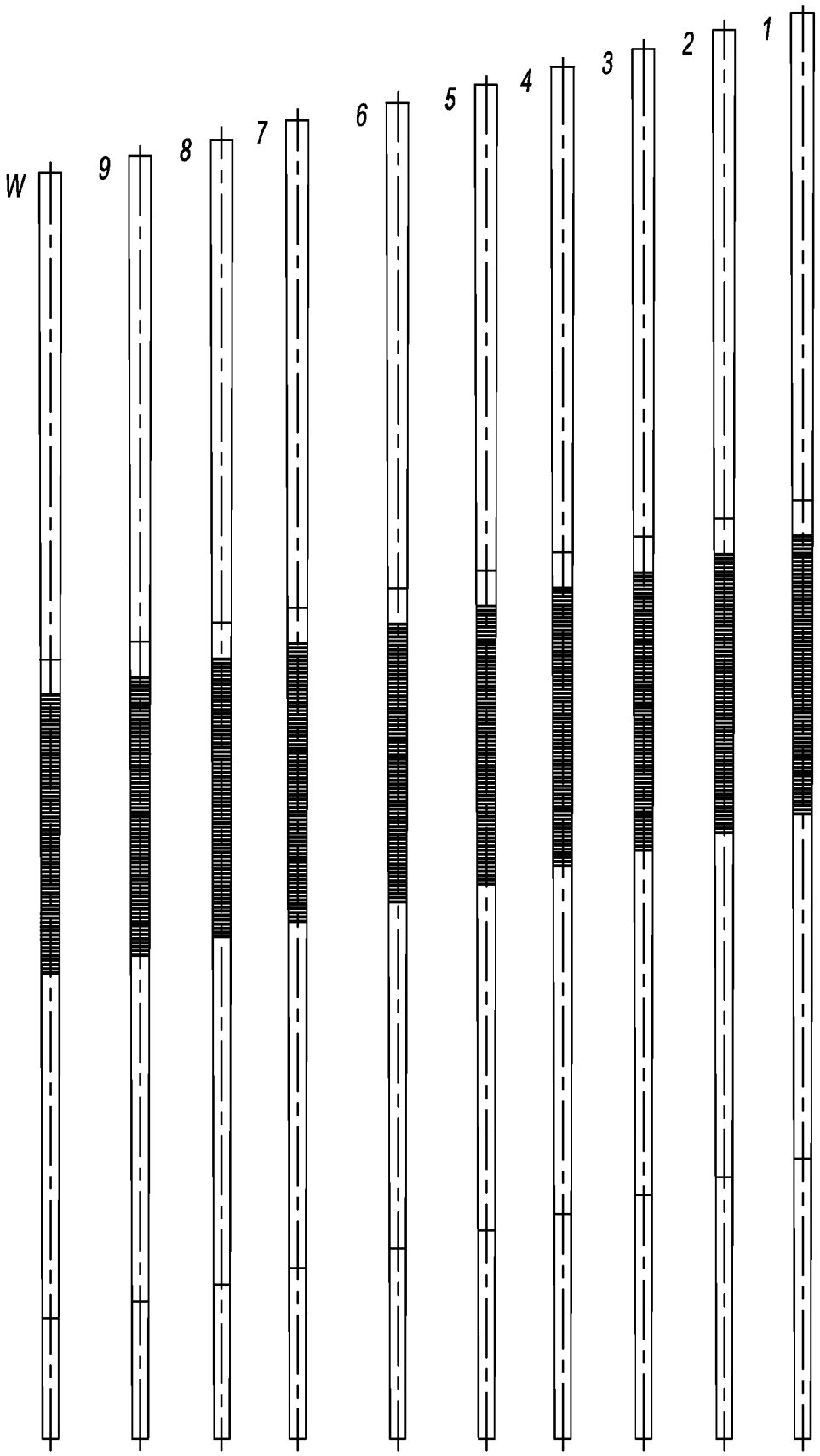
FIG. 8 is a plan view of a series of golf shafts according to the present invention suitable for use in the manufacture of a set of golf clubs.

Turning now to FIG. 8, a plurality of golf shafts according to the first preferred embodiment of the present invention are shown, which have been suitably trimmed for use in the manufacture of a set of golf clubs. In this regard, the longest shaft is adapted for use as a one iron or hybrid, and the shortest shaft is adapted for use as a wedge. The intermediate shafts are thus adapted for use as the remaining progressive irons and hybrids which make up a conventional set of golf clubs. In the preferred embodiment, the size and position of the loading zone is consistent across the entire set so that all of the clubs in the set have a consistent playing characteristic and "feel." It is, of course, possible to vary the size, position, and characteristics of the loading zones of the different shafts if desired.

The conventional manufacturing processes discussed above in the Background which are used to manufacture existing steel golf shafts are not suitable for the manufacture of a steel golf shaft according to the present invention. Specifically, the taper press process described above, which comprises the preferred method of forming diameter reductions typically between 0.010 and 0.025 inches in a very consistent and reliable manner, is unsuited to the production of smaller diameter reductions and closely spaced reductions. In particular, attempts to form smaller diameter reductions (i.e., less than 0.010 inches) can lead to the forming die being pulled to one side, resulting in a non-concentric "half" step and a shaft reject. In addition, it is difficult to achieve acceptable geometric consistency when reducing step spacing of less than 0.50 inches apart.

Accordingly, the present invention seeks to combine the conventional taper press process with a further unique swaging process to form intricate geometric features on the shaft. Heretofore, the swaging process used in the manufacture of steel golf shafts produces a featureless golf shaft, i.e., a so-called plain taper or "stepless" steel golf shaft. With the process according to various preferred embodiments of the present invention, unique swage dies are provided that simultaneously form a plain taper on a portion of the mid-section of the shaft, and the intricate loading zone described above on a remaining portion of the mid-section of the shaft. Alternatively configured swage dies are provided to form each of the various alternative embodiments of the present invention illustrated in FIGS. 2-7.

Figure 9A:
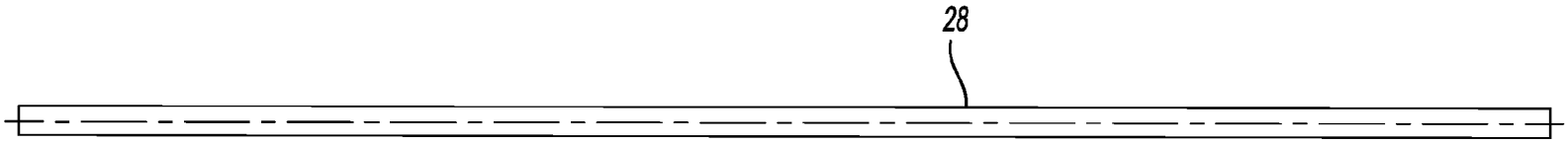
FIG. 9(*a*) illustrates a tubular blank used in the manufacturing process according to the present invention.
Figure 9B:
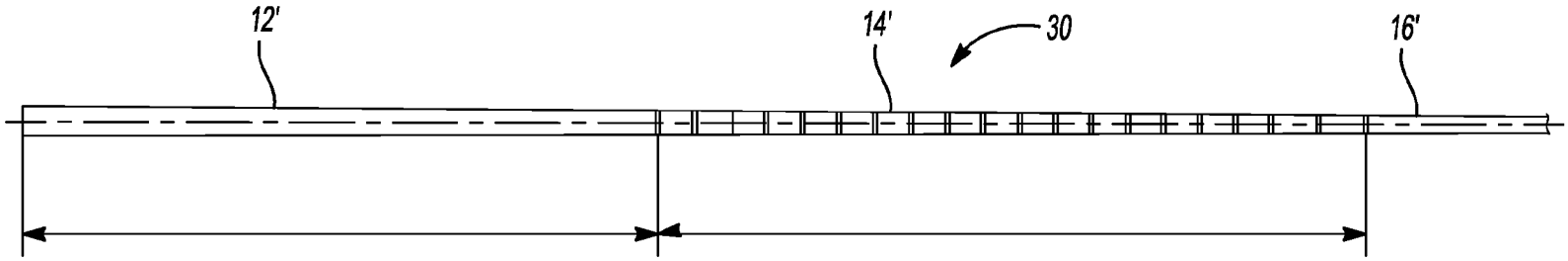
Figure 9C:
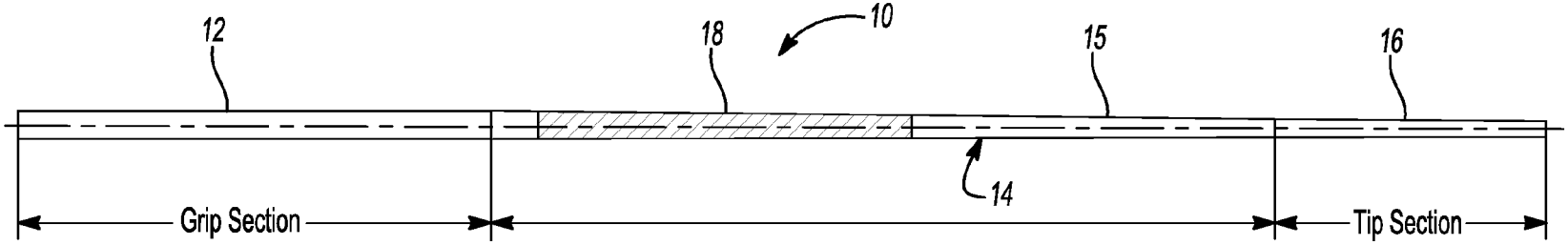

Turning now to FIGS. 9(*a*)-(*c*), the preferred method of manufacturing the golf shaft illustrated in FIGS. 2-3 will now be explained. Initially, a tubular blank 28 having a 0.600 inch diameter, shown in FIG. 9(*a*), is subjected to the taper press process described above to form a preform stepped shaft 30, as illustrated in FIG. 9(*b*). The preferred taper press process is disclosed in commonly-owned U.S. Pat. No. 5,989,133, which is incorporated herein by reference. In addition, the tubular blank 28 may be formed with a uniform wall thickness, or with different wall thicknesses in the grip section, mid-section, and tip section, as also described in U.S. Pat. No. 5,989,133.

Figure 1:
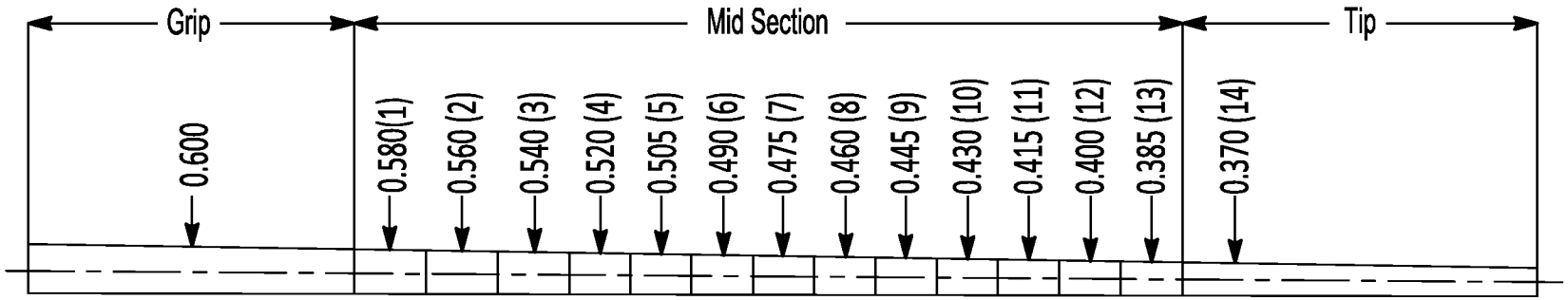
FIG. 1 is a plan view of a prior art steel golf shaft.

In a preferred embodiment, the preform shaft 30 comprises a grip end 12 that maintains the 0.600 inch diameter of the tubular blank 28, a tapered mid-section 14' having a plurality of individual diameter reduction steps, and a tip section 16' that can have a constant diameter of approximately 0.375 inches, or a further taper in accordance with a particular design requirement. In the preferred embodiment illustrated, the mid-section 14', starting at the grip end 12', contains a first series of eighteen reductions of approximately 0.020 inches each, spaced approximately 1.5 inches apart, followed by a second pair of reductions of approximately 0.015 inches each, spaced approximately 1.75 inches apart. Each of the step reductions in the preform shaft 30 is preferably formed with less abrupt or "flatter" steps than would be formed in the production of a conventional stepped golf shaft illustrated in FIG. 1.

Figure 10A:
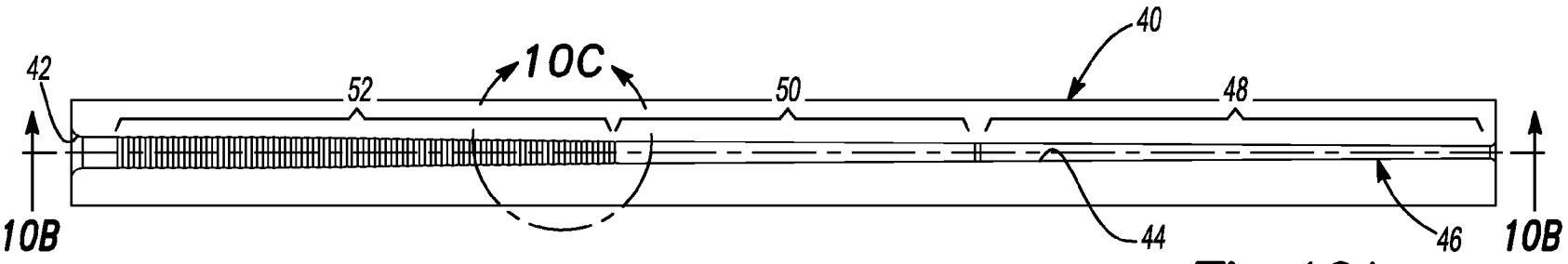
FIGS. 10(*a*)-(*c*) illustrate one half of the swage dies used to produce the preferred final shaft form shown in FIGS. 2 and 3.
Figure 10B:
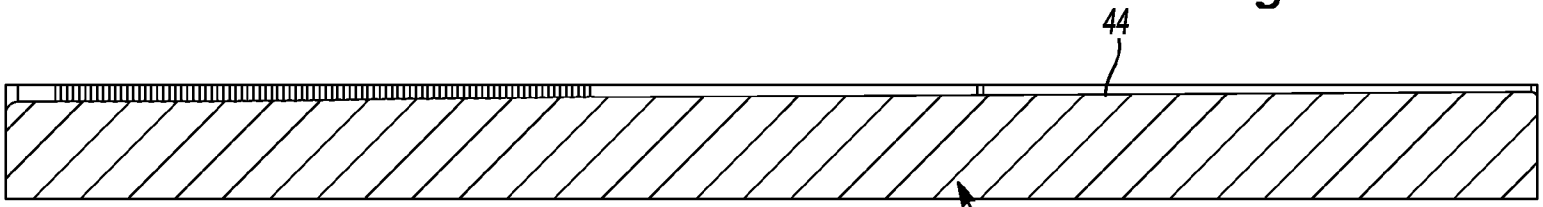
Figure 10C:
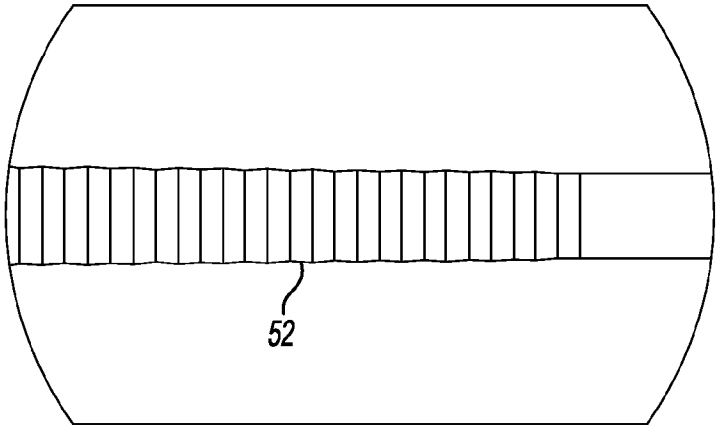

The preform shaft 30 is then subjected to an additional swaging operation using a pair of swaging dies as illustrated in FIG. 10. One of the two "half" swage dies 40 used in the swage process is shown. A second swage die identical to that shown is also used. In the swaging process, the preform shaft 30 illustrated in FIG. 9(*b*) is fed, tip end first, into the input end 42 of the set of half dies 40 which are rotated while simultaneously being opened and closed via a hammering mechanism at very high speed. When closed, the cavities 44 formed in the working surfaces 46 of dies 40 act upon the preform shaft 30 (FIG. 9(*b*)) as it is fed into the dies 40 until the shaft 30 conforms to the configuration of the cavities 44 in the dies 40.

Each die cavity 44 comprises a first section 48 for forming the tip section 16 of the final golf shaft form shown in FIG. 9(*c*), which in this embodiment consists of a constant diameter section of 0.370 inches. Thereafter the cavity form 44 transitions to a constant taper section 50 configured to form a constant taper rate in inches of preferably 0.0128 per lineal inch. Lastly, the cavity form 44 includes a third section 52 containing the intricate circumferential features for forming the plurality of micro-steps in the loading zone 18 of the final golf shaft form. Preferably, the grip portion 12 of the final golf shaft form 10 does not enter into the swage dies 40.

In the preferred embodiment, the overall taper rate of the mid-section 14' of the preform shaft 30 illustrated in FIG. 9(*b*) is equal to the taper rate of the mid-section 14 of the final golf shaft form 10 shown in FIG. 9(*c*). In addition, it will be noted that the total length of the resulting mid-section 14 in the final golf shaft form 10, which includes the loading zone 18, exceeds the length of the mid-section 14' in the preform shaft 30 shown in FIG. 9(*b*). This is due to the fact that the loading zone 18 formed by the third section 52 of the cavity 44 in the swage dies 40 acts upon a portion of the original grip section 12' of the preform shaft 30. In this manner, the material flow resulting from the swaging operation is precisely managed. In addition, the portion of the preform shaft 30 that will ultimately comprise the smooth taper section 15 and tip section 16 of the final shaft form 10 shown in FIG. 9(*c*), are preferably formed with a slightly larger diameter in the preform shaft 30 to thereby insure that the first and second sections 48 and 50 of the swaging dies 40 impart a smooth finish on sections 15 and 16 of the final shaft form 10. However, the diameter of the largest step section in the mid-section 14' of the preform shaft 30 that will define the upper end of the smooth taper section 15 of the final shaft form 10, is preferably formed in the taper press process with a diameter equal to or less than the smallest diameter in the loading zone forming section 52 of the swage dies 40. In this manner, the third section 52 of the swage dies 40 will not act upon and therefore will not mar the finish surfaces of these sections 15 and 16 of final shaft form 10 during the swaging operation.

Optionally, the intermediary taper press process may be eliminated and the tubular blank 28 illustrated in FIG. 9(*a*) fed directly into the swage dies 40. However, the intermediate taper press process comprises a very reliable method of controlling material flow which greatly improves the consistency of the overall manufacturing process, and thus the quality of the resulting golf shaft. In addition, production of the preform shaft 30 via the intermediate taper press process greatly speeds up the swaging process, thereby improving overall production capacity as well.

Following the swaging process, the resulting final shaft form shown in FIG. 9(*c*) is preferably polished and plated to produce the finished golf shaft. In the above described preferred embodiments, as well as in the adjoining claims, the dimensional values recited correspond to the pre-plated values of the shaft form.

Figure 11A:
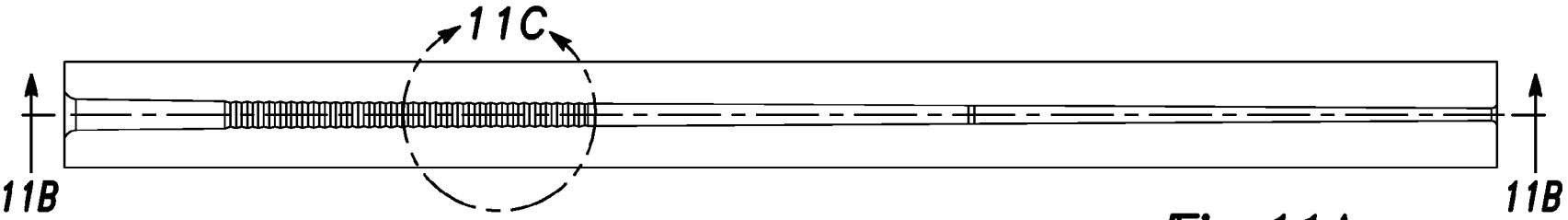
FIGS. 11(*a*)-(*c*) illustrates one half of the swage dies used to produce the alternative final shaft form shown in FIG. 4.
Figure 11B:
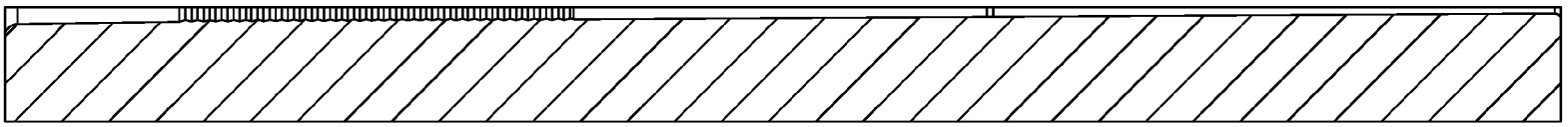
Figure 11C:
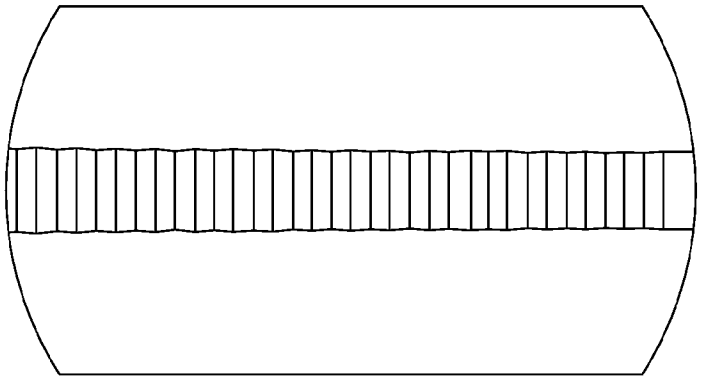

FIGS. 11(*a*)-(*c*) illustrate one half of the swage dies which would be used during the swaging operation instead of the die shown in FIGS. 10(*a*)-(*c*), to provide the alternative final shaft form shown in FIG. 4.

Figure 12A:
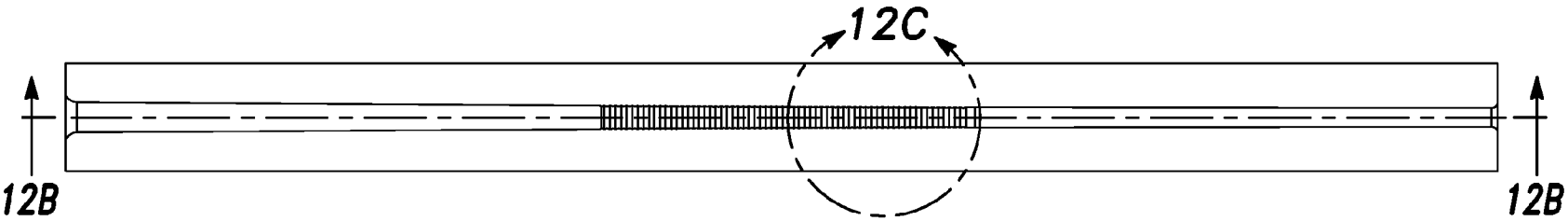
FIGS. 12(*a*)-(*c*) illustrates one half of the swage dies used to produce the alternative final shaft form shown in FIG. 5.
Figure 12B:
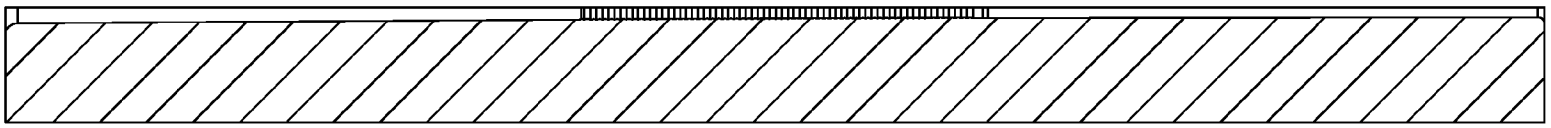
Figure 12C:
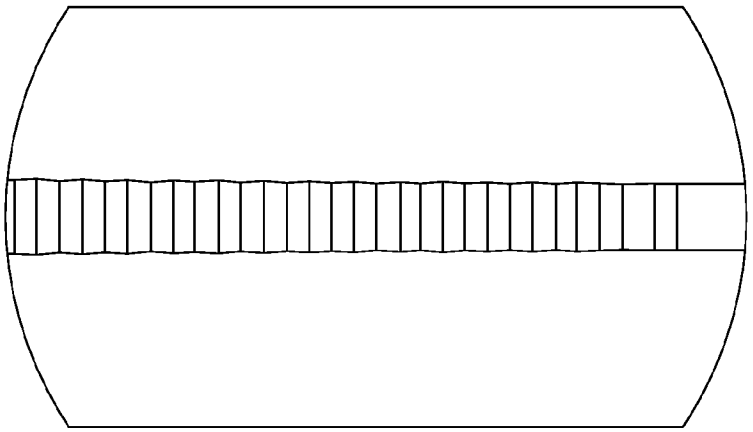

FIGS. 12(*a*)-(*c*) illustrate one half of the swage dies which would be used during the swaging operation instead of the die shown in FIGS. 10(*a*)-(*c*), to provide the alternative final shaft form shown in FIG. 5.

Figure 13A:
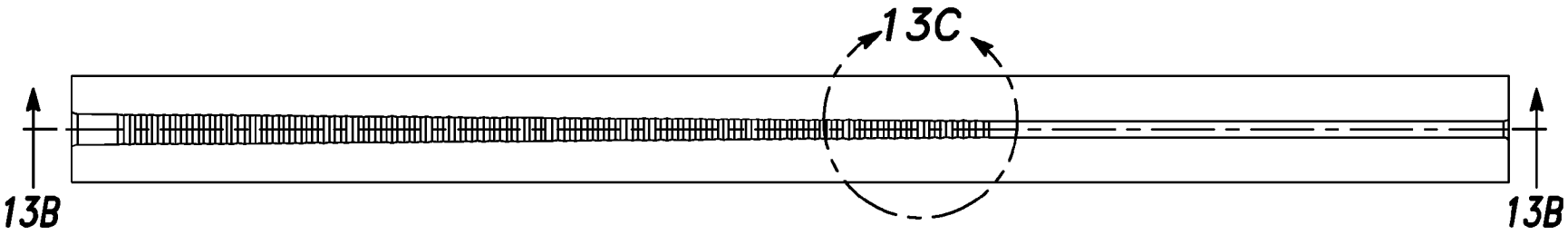
FIGS. 13(*a*)-(*c*) illustrates one half of the swage dies used to produce the alternative final shaft form shown in FIG. 6.
Figure 13B:
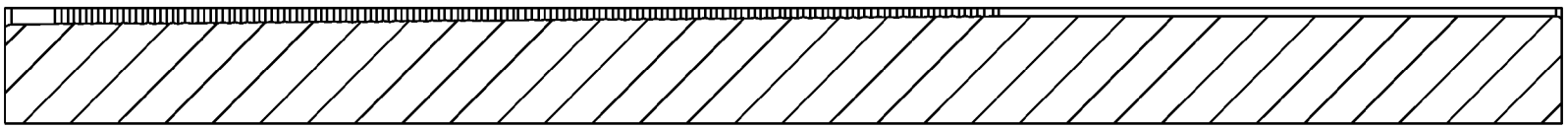
Figure 13C:
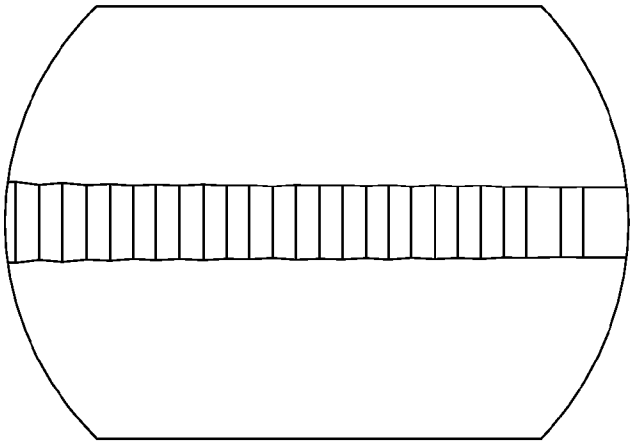

FIGS. 13(*a*)-(*c*) illustrate one half of the swage dies which would be used during the swaging operation instead of the die shown in FIGS. 10(*a*)-(*c*), to provide the alternative final shaft form shown in FIG. 6.

Figure 14A:
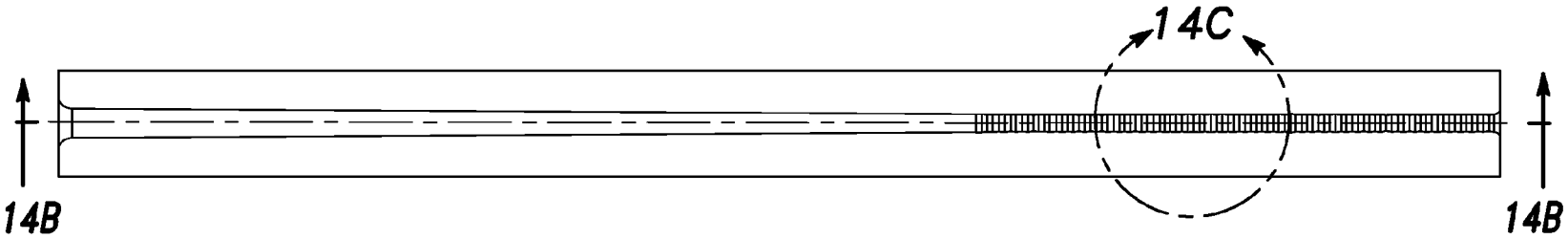
FIGS. 14(*a*)-(*c*) illustrates one half of the swage dies used to produce the alternative final shaft form shown in FIG. 7.
Figure 14B:
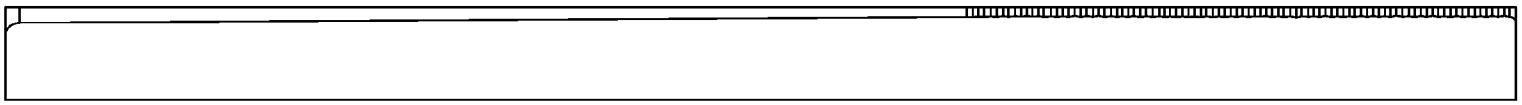
Figure 14C:
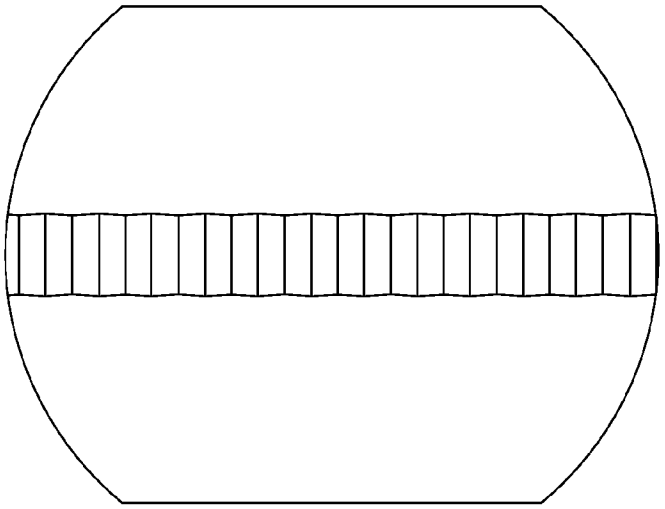

FIGS. 14(*a*)-(*c*) illustrate one half of the swage dies which would be used during the swaging operation instead of the die shown in FIGS. 10(*a*)-(*c*), to provide the alternative final shaft form shown in FIG. 7.

The intermediate preform shaft 30 substantially as shown in FIG. 9(*b*) is preferably used with each of the alternative swage dies illustrated in FIGS. 11-14.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A tubular steel golf shaft form comprising:

a grip section at one end, a tip section at an opposite end, and an intermediate mid-section that connects the grip section to the tip section, wherein the outside diameter of the mid-section tapers from a first diameter at the juncture with the grip section to a second diameter smaller than said first diameter at the junction with the tip section, and further wherein said intermediate mid-section includes a loading zone having an overall taper defined by a taper line and comprising a substantially continuous plurality of micro-step sections; wherein each of said plurality of micro-step sections in the direction from said one end toward said opposite end comprises in cross-section a first peak having a diameter (A) descending at an angle of approximately 1° to approximately 5° relative to said taper line to a valley having a diameter (B) and ascending at an angle of approximately 1° to approximately 5° relative to said taper line to a second peak having a diameter (C), wherein (B) is less than (C) which is less than (A), wherein the lineal distance from said first peak to said second peak is less than 0.5 inches, and further wherein the cross-section in the loading zone is a circle with a fixed radius.

2. The golf shaft of claim 1, wherein the lineal distance from said first peak to said second peak in each micro-step section is between 0.125 and 0.25 inches.

3. The golf shaft of claim 1, wherein the valley in each micro-step section is located substantially midway between said first peak and said second peak.

4. The golf shaft of claim 3, wherein said plurality of micro-step sections are equally spaced.

5. The golf shaft of claim 1, wherein the difference in diameter between (A) and (B) in each micro-step section is less than 0.010 inches.

6. The golf shaft of claim 5, wherein the difference in diameter between (A) and (B) in each micro-step section is greater than 0.003 inches.

7. The golf shaft of claim 1, wherein the second peak of one micro-step section corresponds to the first peak of an adjoining micro-step section.

8. The golf shaft of claim 7, wherein said plurality of micro-step sections are equally spaced.

9. The golf shaft of claim 8, wherein said loading zone comprises a continuous series of at least 24 micro-step sections.

10. The golf shaft of claim 9, wherein the overall taper rate of the loading zone is equal to the taper rate of each micro-step section as defined by the difference in diameter between (A) and (C) and the lineal distance between said first peak and said second peak.

11. A tubular steel golf shaft form comprising:

a grip section at one end, a tip section at an opposite end, and an intermediate mid-section that connects the grip section to the tip section, wherein the outside diameter of the mid-section tapers from a first diameter at the juncture with the grip section to a second diameter smaller than said first diameter at the junction with the tip section, and further wherein said intermediate mid-section includes a loading zone comprising a substantially continuous plurality of micro-step sections; wherein each of said plurality of micro-step sections in the direction from said one end toward said opposite end comprises in cross-section a first peak having a diameter (A) descending to a valley having a diameter (B) and ascending to a second peak having a diameter (C), wherein (B) is less than (C) which is less than (A), wherein the difference in diameter between (A) and (B) is less than 0.010 inches, and further wherein the cross-section in the loading zone is a circle with a fixed radius.

12. The golf shaft of claim 11, wherein the difference in diameter between (A) and (B) in each micro-step section is greater than 0.003 inches.

13. The golf shaft of claim 11, wherein the lineal distance from said first peak to said second peak in each micro-step section is between 0.125 and 0.25 inches.

14. The golf shaft of claim 11, wherein the second peak of one micro-step section corresponds to the first peak of an adjoining micro-step section.

15. The golf shaft of claim 14, wherein said loading zone comprises a continuous series of at least 32 micro-step sections.

16. The golf shaft of claim 15, wherein the overall taper rate of the loading zone is equal to the taper rate of each micro-step section as defined by the difference in diameter between (A) and (C) and the lineal distance between said first peak and said second peak.

17. The golf shaft of claim 14, wherein said plurality of micro-step sections are equally spaced, and further wherein the lineal distance from said first peak to said second peak in each micro-step section is less than 0.5 inches.

18. The golf shaft of claim 17, wherein the valley in each micro-step section is located substantially midway between said first peak and said second peak.

19. The golf shaft of claim 18, wherein the lineal distance from said first peak to said second peak in each micro-step section is between 0.125 and 0.25 inches.

20. The golf shaft of claim 11, wherein the loading zone has an overall taper rate defined by a taper line, and further wherein the first peak of each micro-step section descends at an angle of approximately 1 degree to approximately 5 degrees relative to said taper line to the valley and ascends from said valley at an angle of approximately 1 degree to approximately 5 degrees to the second peak.

21. A tubular steel golf shaft form comprising:

a grip section at one end, a tip section at an opposite end, and an intermediate mid-section that connects the grip section to the tip section, wherein the outside diameter of the mid-section tapers from a first diameter at the juncture with the grip section to a second diameter smaller than said first diameter at the junction with the tip section, and further wherein said intermediate mid-section includes a loading zone having an overall taper defined by a taper line and comprising a continuous plurality of micro-step sections; wherein each of said plurality of micro-step sections in the direction from said one end toward said opposite end comprises in cross-section a first peak having a diameter (A) descending at an angle of approximately 1° to 5° relative to said taper line to a valley having a diameter (B) and ascending at an angle of approximately 1° to 5° relative to said taper line to a second peak having a diameter (C), wherein (B) is less than (C) which is less than (A), wherein the second peak of one micro-step section corresponds to the first peak of an adjoining micro-step section, wherein the lineal distance from said first peak to said second peak in each micro-step section is between 0.125 and 0.25 inches, and further wherein the cross-section in the loading zone is a circle with a fixed radius.

22. The golf shaft of claim 21, wherein said continuous plurality of micro-step sections extends over a length of at least 6 inches.

23. The golf shaft of claim 21, wherein said continuous plurality of micro-step sections extends over a length of at least 8 inches.

* * * * *